US005788138A

United States Patent [19]

Deschenes et al.

[11] Patent Number: 5,788,138

[45] Date of Patent: Aug. 4, 1998

[54] BUTTON ATTACHING DEVICE

[75] Inventors: Charles L. Deschenes, North Attleboro; Paul A. Davignon, Uxbridge; Douglas Cooke, Charlestown; Terrence K. Jones, Sharon, all of Mass.

[73] Assignee: Avery Dennison Corporation, Pasadena, Calif.

[21] Appl. No.: 754,585

[22] Filed: Nov. 19, 1996

[51] Int. Cl.[6] ..... D05B 85/00

[52] U.S. Cl. ..... 227/67; 227/71; 227/134

[58] Field of Search ..... 227/67, 68, 70, 227/71, 134, 120; 112/222; 24/90.1

[56] References Cited

U.S. PATENT DOCUMENTS

| | | | |
|---|---|---|---|
| 216,895 | 6/1879 | Rollins | 227/67 |
| 1,343,289 | 6/1920 | Suchy | 227/71 |
| 3,875,648 | 4/1975 | Bone | 227/71 |
| 3,900,925 | 8/1975 | La Torraca | 24/90.1 |
| 4,316,562 | 2/1982 | Davidson et al. | 227/68 |
| 5,518,162 | 5/1996 | Deschenes et al. | 227/71 |
| 5,588,575 | 12/1996 | Davignon | 227/67 |

*Primary Examiner*—Scott A. Smith
*Attorney, Agent, or Firm*—Kriegsman & Kriegsman

[57] ABSTRACT

A button attaching device for attaching a button to a layer of material includes a C-frame having a top portion, an intermediate portion and a bottom portion. A plurality of needle block assemblies are disposed inside the top portion of the C-frame in a stack. A manually operable plunger is slidably mounted on the top portion of the C-frame for up and down movement and positioned to receive and move downward the lowermost needle block assembly in the stack. Each needle block assembly includes a block of elastomeric material, a pair of rodless fastener dispensing needles and a fastener of the type having a foot at each end of a filament. Each foot is removably mounted on one of the pair of rodless fastener dispensing needles. In use, a button and a layer of material to which the button is to be attached are positioned on top of an anvil formed on the bottom portion of the C-frame. The lowermost needle block assembly is pushed down by the plunger so that the needles extend through a pair of holes in the button and through the layer of material. The plunger is then retracted leaving the button secured to the layer of material by the fastener.

5 Claims, 2 Drawing Sheets

BUTTON ATTACHING DEVICE

BACKGROUND OF THE INVENTION

The present invention relates to a button attaching device and, more particularly to a hand operated button attaching device.

In U.S. Pat. No. 3,900,925 to G. A. LaTorrace there is disclosed a one piece, durable button attaching device comprising a hollow pointed needle portion having a longitudinal slot along a portion of the top thereof. The rear end of the needle is immovably mounted in a rounded handle portion or other gripping means. Angular shaped fasteners having a vertical shank with a pair of oppositely slanting legs extend an equal distance form top and bottom thereof forming approximately a 55 degree angle on one side of the shank and a 125 degree angle relative thereto on the other side.

In U.S. Pat. No. 4,281,782 to W. H. W. Marsh et al. there is disclosed a button sewing device which includes a base, a pair of needles which carry collapsible thread formed loops and project from the base for use in penetrating a layer of material and the holes of a button to be attached to the material, and with elastomeric material over the base compressible by pressure on the material to which the button is to be attached, and expandable to raise such material and thereby cause the loops to be opened above the button for receiving a thread bundle.

In U.S. Pat. No. 4,296,698 to R. D. Davidson et al. there is disclosed a button attaching hand tool comprising a box-like structure which includes a fixed and adjustable needle, and which includes a button storage compartment. A slidable shroud on the box-like structure for extricating a button and material from the needles is movable between a position in which an operator is shielded from injury by the needles and another position in which the needles are exposed for button sewing use.

In U.S. Pat. No. 4,316,562 to D. R. Davidson et al. there is disclosed a button attaching tool which includes a base, a pair of needles which have collapsible and expendable thread receiving eyes and which project from the base for use in penetrating a layer of material and the holes of a button to be attached to the material, and a member for stripping the material and button from the needles.

In U.S. Pat. No. 4,361,101 to W. H. W. Marsh et al. there is disclosed a button attaching device having a bifurcated needle holding member which can be utilized to adjust the spacing between a pair of needles, and with a needle cover which attaches to the bifurcated member to protect one from injury by the needles and form a unit that can be conveniently carried on he person of a user.

In U.S. Pat. No. 5,518,162 to C. L. Deschenes et al., which patent is incorporated herein by reference, there is disclosed a fastener attaching tool particular suited for use in attaching buttons to clothing, etc. and which is constructed for use with a fastener clip which includes a pair of runner bars and one or more U-shaped fasteners having transverse bars at opposite ends, each transverse bar being connected on its side to a corresponding runner bar by a severable connector post. The tool includes a body having a front end. A pair of needles are pivotally mounted at the front end of the body, each needle having a longitudinal slotted bore adapted to receive one of the transverse bars and a knife edge formed on one side which is adapted to a connector post from its associated transverse bar as the transverse bar is pushed through the needle. The body is shaped to include a transverse feed slot down through which the fastener clip is manually inserted. The tool also includes an ejector mechanism which is slidable mounted back and forth within the body and is rearwardly biased by a spring. The ejector mechanism is moved manually forward from the rear of the tool and includes a pair of ejector rods which are in the needles. The body includes a pair of flexible fingers which cooperate with a pair of posts on the ejector mechanism to prevent automatic return of the ejector mechanism from its forwardmost position in the body to its rearwardmost position when forward pressure on the ejector mechanism is removed.

In U.S. patent application Ser. No. 08/305,486 filed on Sep. 13, 1994 in the name of Paul A. Davignon and assigned to the assignee of this application and which is incorporated herein by reference, there is disclosed a needle for use in the rodless dispensing of plastic fasteners of the type comprising a flexible filament and a cross-bar disposed at one end of the flexible filament. In one embodiment, the needle comprises a solid elongated member terminating at its front end in a top adapted to penetrate a desired article of commerce and a chamber adapted to receive a cross-bar of a plastic fastener. The chamber includes a front end, a rear end, an open top and an open bottom. The open top, which is spaced rearwardly a distance from the tip, is appropriately sized and shaped to permit the insertion and removal of a cross-bar into and from the chamber. The front end is downwardly angled towards the tip to releasably engage the top surface of the front end of the cross-bar, and the rear end has a pair of walls intersecting a V-shape to releasably engage both the top surface and the bottom surface of the rear end of the cross-bar in such a way as prevent the cross-bar from being pulled out of the chamber through the open top when low tension is applied to the flexible filament (i.e., prior to the complete insertion of the cross-bar through the article of commerce), but, yet, so as to cause the cross-bar to be pulled out of the chamber through the open top when high tension is applied to the flexible filament (i.e. following the complete insertion of the cross-bar through the article of commerce).

Another reference of interest includes U.S. Pat. No. 3,399,432 to F. G. Merser.

Accordingly, it is an object of this invention to provide a new and improved button attaching device.

It is a another object of this invention to provide a button attaching device which is hand operated and which is portable.

It is a further object of this invention to provide a button attaching device which is simple in construction, contains a minimum number of parts, inexpensive to manufacture and easy to use.

SUMMARY OF THE INVENTION

A button attaching device constructed according to the teachings of this invention for attaching a button to a layer of material includes a frame having a top portion and a bottom portion, the bottom portion including an anvil for providing support for the layer of material, a needle block assembly disposed inside the top portion of the frame, the needle block assembly including a block of material, a pair of rodless fastener dispensing needles mounted on the block of material and a fastener having a foot at each end of a filament, each foot being removably mounted on one of the pair of rodless fastener dispensing needles and a plunger for moving the needle block assembly down from the top portion in the direction of the anvil.

Various features and advantages of the present invention will be set forth in part in the description which follows, and in part will be obvious from the description or may be learned by practice of the invention. An embodiment will be described in sufficient detail to enable those skilled in the art to practice the invention, and it is to be understood that other embodiments may be utilized and that changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings wherein like reference numerals represent like parts.

DETAILED DESCRIPTION OF PREFERRED EMBODIMENTS

Figure 1:
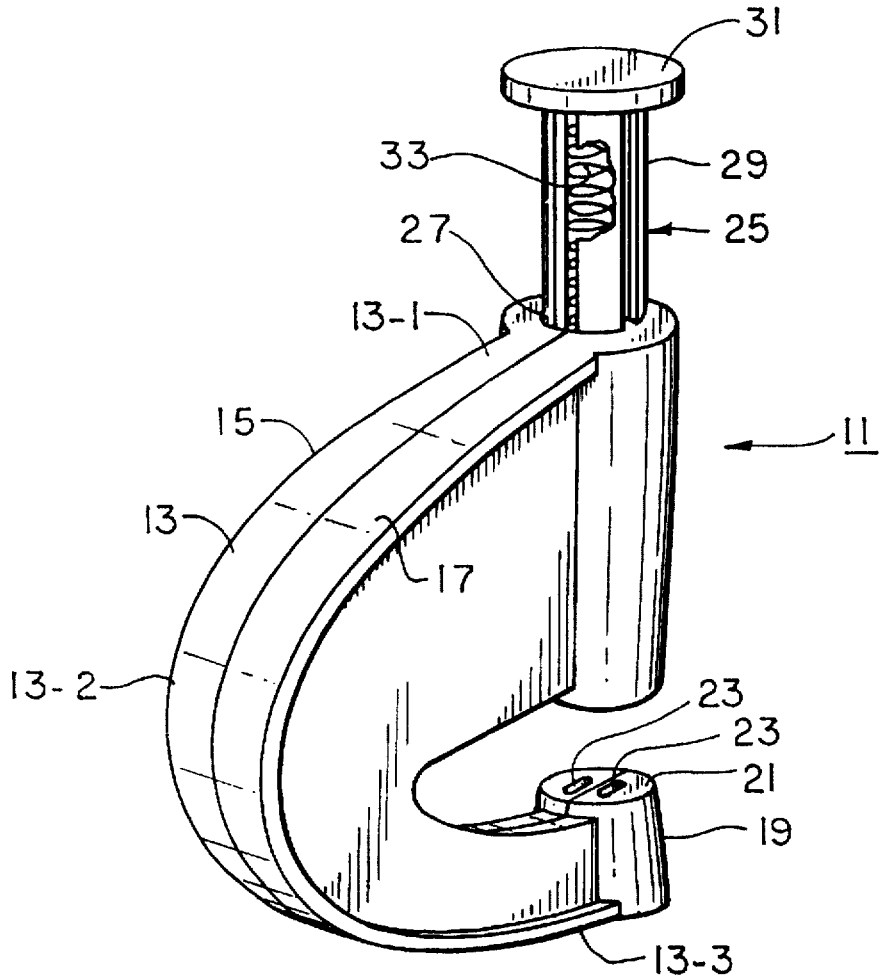
FIG. 1 is a perspective view of a button attaching device constructed according to this invention for attaching a button to a layer of material.
Figure 6:
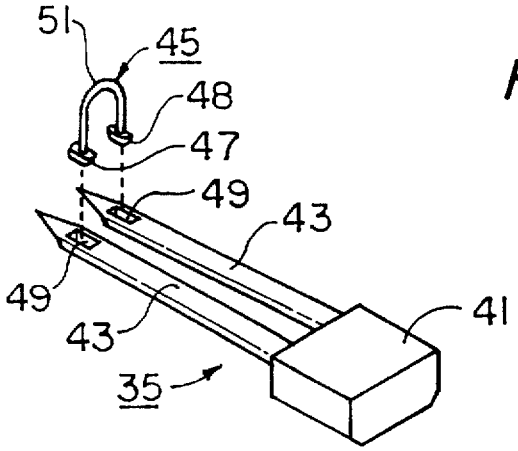
FIG. 6 is an exploded perspective view of one of the needle block assemblies shown in FIG. 1.
Figure 7:
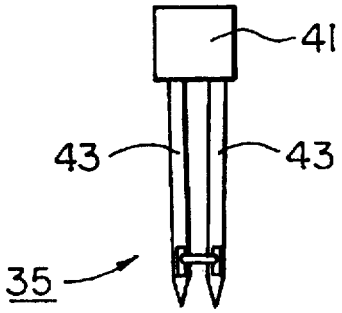
FIG. 7 is an elevation view of one of the needle block assemblies.

Referring now to the drawings, there is shown a button attachment device constructed according to this invention and identified by reference numeral 11.

Button attachment device 11 includes a hollow C-frame 13 made of a durable plastic and having a left side 15 and a right side 17, the two sides being secured together by any suitable means, such as screws, not shown. C-frame 13 includes a top portion 13-1 an intermediate portion 13-2 and a bottom portion 13-3. Bottom portion 13-3 of C-frame 13 is shaped to define a hollow boss 19 having a top surface 21 which serves as an anvil. Top surface 21 includes a pair of needle receiving holes 23. A plunger 25 projects down into C-frame 13 through an opening 27 formed in the top portion 13-1 of frame 13. Plunger 25 includes a hollow stem 29 having a top 29-1 and a bottom 29-2 and a cap 31 at top 29-1 of stem 29. Bottom 29-2 of stem 29 is shaped to define a cavity 29-3 for use in removably holding a needle block assembly as will hereinafter be explained. A spring 33 is disposed inside hollow stem 29 and pushes at its top end on the bottom of cap 31 and at its bottom end against a step 34 integrally formed inside C-frame 13. Thus, plunger 25 is normally biased upward. As can be seen, step 34 extends into stem 29 through a vertical slot 34-1 in plunger 19.

A plurality of needle block assemblies 35-1 through 35-3 are disposed in a stack one behind the other in a downwardly angled chute 37 formed inside C-frame 13. A spring 39 attached at one end to frame 13 and at the other end to a pusher block 39-1 pushes assemblies 35 toward exit opening 40 at the bottom of chute 37. Another needle block assembly 35-4 is seated in a recess 25-1 at the bottom of plunger 25.

Each needle block assembly 35 includes a block 41, a pair of rodless fastener dispensing needles 43 fixedly mounted on block 41 and a fastener 45 removably mounted on rodless fastener dispensing needles 43. Block 41 is made of elastomeric material so that needles 43 can be angularly moved to accommodate different button hole spacings. Needles 43 are rodless fastener dispensing type needles and may be, for example the rodless fastener dispensing needles disclosed in U.S. patent application Ser. No. 08/305,486. Fastener 45 is made of plastic and includes a pair of feet 47 and 48 interconnected by an elongated filament 51. Feet 47 and 48 are removably seated in cavities 49 formed near the front end of needles 39. Fastener 41 may be, for example, the type of fastener which is disclosed in U.S. Pat. No. 5,518,162.

Figure 3:
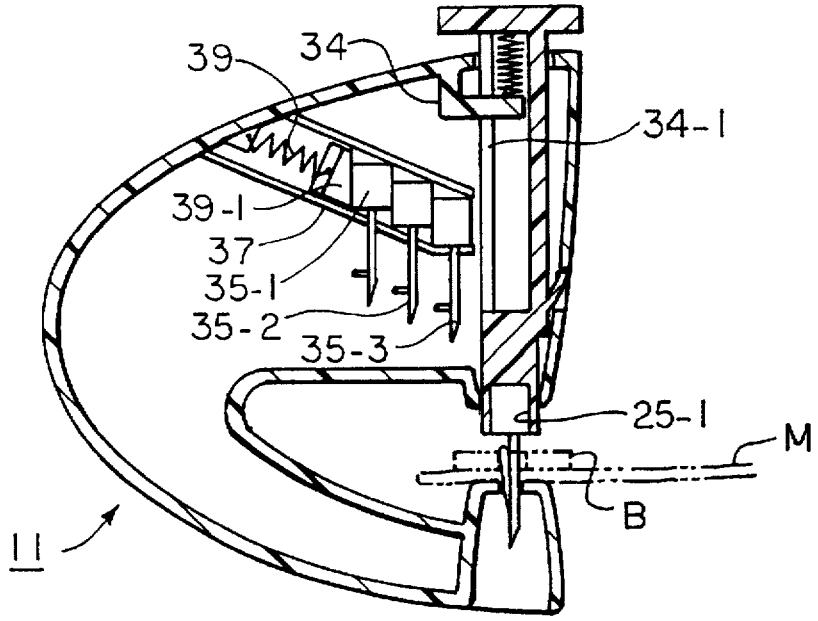
FIG. 3 is a side section view of the button attaching device shown in FIG. 1, with the plunger in a down position.
Figure 4:
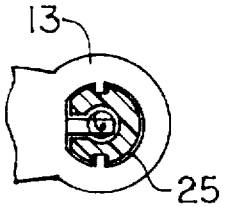
FIG. 4 is a fragmentary view taken along lines 4—4 shown in FIG. 2.
Figure 2:
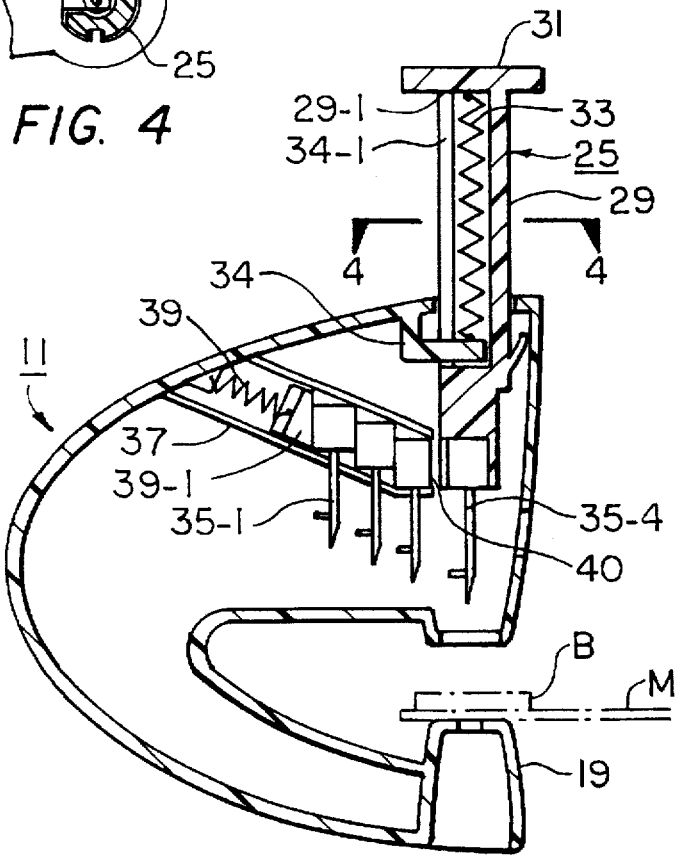
FIG. 2 is a side section view of the button attaching device shown in FIG. 1, with the plunger in an up position.
Figure 5:
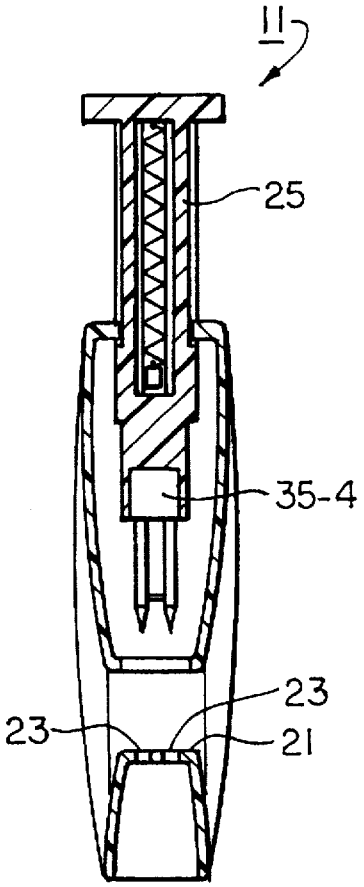
FIG. 5 is a front section view of the button attaching device shown in FIG. 1.

To use device 11, a person places a button B having a pair of holes and a layer of material M to which button B is to be attached on anvil 21 as shown in FIG. 2. The user then pushes plunger 25 so that tips of needles 43 in needle block assembly 35-4 seated in recess 25-1 in plunger 25 pass through the holes in button B, pass through layer of material M and through holes 23 in anvil 21 as shown in FIG. 3. The tension applied to filament 51 due to the length of filament 51 and the thickness of button B and the thickness of layer M causes feet 47 and 49 of fastener 45 to pop out of cavities 49. The user then removes downward pressure on plunger 25 causing plunger 25 to move up and return to the position shown in FIG. 2 with button B being secured to layer M by fastener 45. Holes 23 in anvil 21 are appropriately sized relative to feet 47 and 49 so that feet 47 and 49 will not be caught inside boss 19 when needles 43 are withdrawn. The remainder of needle block assembly 35-4 (i.e., block 41 and pair of needles 43) is then removed manually from cavity 29-3 in plunger. Once needle block assembly 35-1 has been removed, needle block assembly 35-2 will be pushed into cavity 29-3 of plunger 25 by spring 39.

Instead of having a single pair of needles, the needle block assemblies could, if desired, have two pairs of needles. Also, the portion of frame 13 to which spring 39 is attached could be removable so that replacement needle block assemblies could be loaded into the chute.

What is claimed is:

1. A button attaching device comprising:

a frame having a top portion and a bottom portion, the bottom portion including an anvil, a plunger mounted for up and down movement in the frame, and a needle block assembly disposed in the plunger, the needle block assembly including:

a block of material, a pair of rodless fastener dispensing needles mounted on the block of material, and a fastener having a foot at each end of a filament, each foot being removably mounted on one of the pair of rodless fastener dispensing needles.

2. The button attaching device of claim 1 wherein the frame is C-shaped.

3. The button attaching device of claim 2 wherein said frame includes a chute for holding a plurality of needle block assemblies in a stack.

4. The button attaching device of claim 3 wherein said plunger is normally biased in an upward position.

5. A button attaching device comprising:

a frame having a top portion and a bottom portion, the bottom portion including an anvil, a plurality of needle block assemblies movably disposed in a stack in the top portion of the frame, each needle block assembly including a block of material, a pair of rodless fastener dispensing needles mounted in the block of material, and a fastener mounted on the pair of needles, the fastener comprising a pair of feet connected by a filament, and a plunger for receiving the lowermost needle block assembly in the stack and moving said needle block assembly down toward the anvil.

* * * * *